US005873679A

United States Patent [19]

Cusimano

[11] Patent Number: 5,873,679

[45] Date of Patent: Feb. 23, 1999

[54] SEISMIC FOUNDATION PIER WITH GROUND ANCHOR MEANS

[76] Inventor: Matt Cusimano, 267 Aptos Beach Dr., Aptos, Calif. 95003

[21] Appl. No.: 748,125

[22] Filed: Nov. 12, 1996

[51] Int. Cl.[6] ..... B60R 27/00; E02D 5/80

[52] U.S. Cl. ..... 405/231; 52/169.12; 52/169.9; 52/299; 405/229; 405/244; 405/251

[58] Field of Search ..... 405/229, 230, 405/231, 244, 251; 52/169.12, 169.9, 299, DIG. 3

[56] References Cited

U.S. PATENT DOCUMENTS

| | | | |
|---|---|---|---|
| 1,808,633 | 6/1931 | Carver . | |
| 2,870,884 | 1/1959 | Mazur | 189/90 |
| 3,324,666 | 6/1967 | Lee | 405/231 |
| 3,788,335 | 1/1974 | Hemmelsbach | 135/1 R |
| 3,937,436 | 2/1976 | Stewart | 248/499 |
| 4,052,827 | 10/1977 | Yancey | 52/156 |
| 4,261,149 | 4/1981 | Gustafson | 52/292 |
| 4,685,258 | 8/1987 | Av-Zuk | 52/299 X |
| 4,937,989 | 7/1990 | Miyares et al. | 52/126.7 |
| 5,039,256 | 8/1991 | Gagliano | 405/244 |
| 5,083,404 | 1/1992 | Schulte | 52/167 R |
| 5,243,795 | 9/1993 | Roberts | 52/158 |
| 5,363,610 | 11/1994 | Thomas et al. | 52/167 R |
| 5,395,184 | 3/1995 | Gagliano | 405/229 |
| 5,590,494 | 1/1997 | Miller | 52/169.9 |
| 5,595,366 | 1/1997 | Cusimano et al. | 248/354.3 |
| 5,697,191 | 12/1997 | MacKarvich | 52/169.9 |
| 5,711,504 | 1/1998 | Cusimano | 248/354.3 |

*Primary Examiner*—David J. Bagnell
*Assistant Examiner*—Tara L. Mayo
*Attorney, Agent, or Firm*—Robert Charles Hill

[57] ABSTRACT

A foundation pier for supporting a movable dwelling, such as a mobile home or commercial coach, is provided with an anchor assembly for positively anchoring the pier to the ground. The invented pier includes a plurality of force distribution members affixed to a base and an adjustment mechanism of the pier. The force distribution members are coupled to the adjustment mechanism for distributing force, including temporarily increased environmental forces applied to the dwelling and to the pier, to prevent the pier from failing. The adjustment mechanism adjusts the height of the pier and includes coupling members for securing the pier to a support beam of the dwelling. Clamp members are affixed to the force distribution members for causing the force distribution members to cooperate with the adjustment mechanism to increase the pier's ability to withstand increased environmental forces. The anchor assembly comprises a plurality of guides, a guide affixed to each force distribution member, and a plurality of rods, each rod configured to slide through a guide and extend into the ground. The guides are affixed to the force distribution members, so that rods extend obliquely into the ground for anchoring the pier to the ground. Preferably, the guides are affixed to the force distribution members so that rods extend into the ground in either a converging fashion or diverging fashion for positively anchoring the pier to the ground.

19 Claims, 3 Drawing Sheets

SEISMIC FOUNDATION PIER WITH GROUND ANCHOR MEANS

BACKGROUND OF THE INVENTION

1. Field of the Invention

The present invention relates generally to foundations for movable dwellings, such as mobile homes and commercial coaches, and more particularly, to an improved pier for supporting a movable dwelling that substantially resists environmental forces, such as seismic and wind forces, and which includes means for anchoring the pier to a ground surface.

2. Description of Related Art

Movable dwellings, such as mobile homes and commercial coaches for example, typically comprise a prefabricated modular unit, that is somewhat longer than it is wide, to provide facile transportation of the unit. The unit is provided with a plurality of spatially positioned, elongated support girders or beams that extend parallel to the longitudinal axis of the unit. The support beams often have an "I" cross sectional configuration. A plurality of spatially positioned floor joists, that may have either a "J" or "C" cross sectional configuration, are supported by the beams and extend across the width of the unit. Additionally, some movable dwellings may incorporate a perimeter chassis with a beam having a "C" configuration.

Because these dwellings are movable, foundation systems incorporating piers are a preferable system for supporting the dwelling at an installation site, since the system can be disassembled if it is desired to move the dwelling. The piers are typically placed on a ground surface of the installation site and secured to beams of the unit, for supporting the unit. The piers are usually positioned beneath a beam, at an intersection of the beam and a joist, for example. The distance between the piers is usually governed by such factors as the dimensions of the unit and applicable building codes at the installation site of the unit.

Foundation piers in the prior art pier often comprise a base for supporting the pier on the ground of the installation site and a pair of opposing supports affixed to the base. The piers include suitable means for coupling adjustable extensions, affixed to the supports, to a beam of the unit. The coupling means may comprise a platform that abuts the beam and a pair of brackets, coupled to the platform. The coupling means are fastened to the desired beam, to secure the pier thereto.

A disadvantage of foundation piers for movable dwellings in the prior art, is that the coupling means is somewhat unstable due to the length of the shafts. A further disadvantage of these piers, is that when increased forces are applied to the pier, such as seismic activity and wind forces, the extensions may shear the bolts causing the pier to fail.

Another prior art foundation pier for supporting a movable dwelling, such as a mobile home or commercial coach, is disclosed in U.S. patent application Ser. No. 08/384,666, filed Feb. 6, 1995, now U.S. Pat. No. 5,595,366, wherein Applicant is one of the joint inventors. The pier disclosed therein includes a base having a threaded shaft, with a plurality of webs spatially positioned about the shaft. An adjustable support member has a first end threadably coupled to the shaft and couple members detachably coupled to a second end. The couple members attach the pier to a support beam of the movable dwelling, to prevent movement between the pier and the dwelling. A clamp member, affixed to the plurality of webs, couples to the support member for preventing relative movement between the support member shaft and clamp member. Environmental forces applied to the support member are transmitted from the clamp member and distributed through the plurality of webs to prevent the pier from collapsing.

A disadvantage of the disclosed pier, along with other piers in the prior art, is that the pier is not sufficiently secured to the ground. Piers, such as the pier disclosed in U.S. patent application Ser. No. 08/384,666, that are not secured to the ground are typically capable of withstanding approximately 1000 pounds of force. Since a movable dwelling that is approximately 24 feed wide, 60 feet long, and 10 feet tall is capable of generating approximately 12,000 pounds of force, due to wind forces for example, approximately 12 prior art piers must be used to in a foundation supporting such a dwelling. Thus, a pier that is capable withstanding greater force would be advantageous since less piers would be required to provided sufficient support in the foundation system.

However, it is known in the prior art to secure objects to the ground using various means. One particular means for securing a pier or other objects to the ground comprises an auger type device that screws into the ground. Augers suffer from a number of drawbacks, most notably that they extend a substantial distance into the ground, making them difficult to deploy, and that they do not always hold securely.

In a setting such as a mobile home park where a plurality of augers could be used to secure a foundation pier to the ground, subterranean utility connections may be damaged by the auger, when screwing the auger into the ground. Particularly, since the utility connections, such as electrical, gas, and water lines are buried from two to three feet beneath the surface and the auger is screwed into the ground up to approximately three feet in depth, the auger may potentially contact a buried utility connection, causing damage to the connection. Another disadvantage of augers, is that in soft or sandy soil the auger does not always provide a secure hold in the ground. This is due to the fact that the auger only engages an area of the ground as large as the diameter of the helical flange that extends about the auger's shaft.

Another known means for securing objects to the ground comprises a plurality of stake or rod members that extend into the ground and are coupled to a central plate or hub. One such means is disclosed in U.S. Pat. No. 5,243,795, to Roberts. The disclosed device comprises a tie down stake that is useful for anchoring small aircraft or other objects to the ground. The tie down stake consists of a central hub with an eyelet and a plurality of holes that serve as stake guides for directing a plurality of anchoring rods at a fixed angle downward and outward into the ground. The rods, joined by the hub, cooperate together to form a secure earth anchor.

U.S. Pat. No. 1,808,633, to Carver, discloses a ground anchor and like anchoring device. The disclosed device includes an anchor member having a plurality of wings radiating from the vertical axis thereof. Each wing has in its extreme corners, a pair of guides disposed one above the other. Stakes are adapted to be driven diagonally downwardly, so that each stake passes through an upper guide and then through a lower guide of the nearest possible opposite wing.

U.S. Pat. No. 5,039,256, to Gagliano, is directed to a pinned foundation system. The disclosed foundation system purportedly has resiliency under certain loading conditions and requires minimum excavation. The system has a cast footing in combination with a plurality of sleeves through which piles may be driven into the soil to create the necessary bearing, uplift, and lateral forces to support a structure. The sleeves are retained in a fixed position relative to the footing, at predetermined angles, corresponding to the specific structure loading characteristics desired for the ensuing foundation.

U.S. Pat. No. 2,870,884, to Mazur, discloses a ground anchor that converts horizontal pull into a vertical thrust. The anchor disclosed therein comprises a plate member adapted to rest on, and be supported by, the ground and to transfer forces over a relatively large area of the ground beneath the plate. The plate has a plurality of openings therein through which spikes or pins may be driven into the ground to hold the plate in place. Reinforcement members extending longitudinally of the plate and an attachment member to which a cable or chain is secured are additionally provided.

U.S. Pat. No. 4,052,827, to Yancey, discloses a ground anchor and foundation support, U.S. Pat. No. 3,788,335, to Hemmelsbach, discloses an anchor means for a portable building structure, and U.S. Pat. No. 3,937,436, to Stewart, discloses an anchoring apparatus.

While the above enumerated prior art references have improved features, they fail to disclose all of the advantageous features achieved by the improved seismic pier of the present invention that includes means for anchoring the pier to a ground surface.

OBJECTS OF THE INVENTION

It is therefore an object of the present invention to provide an improved pier for supporting a movable dwelling;

It is another object of the present invention to provide an improved pier for supporting a movable dwelling that is capable of withstanding increased forces applied thereto due to environmental activity such as seismic activity and wind, and which incorporates means for anchoring the pier to a ground surface;

It is a further object of the present invention to provide an improved pier for supporting a movable dwelling that incorporates means for anchoring the pier to a ground surface and which is capable of withstanding up to approximately three times the force that prior art piers are capable of withstanding, thus requiring fewer piers in the foundation system; and It is still another object of the present invention to provide an improved pier for supporting a movable dwelling that incorporates means for anchoring the pier to a ground surface and which anchoring means do not extend excessively into the ground.

SUMMARY OF THE INVENTION

These and other objects and advantages of the present invention are achieved by providing an improved foundation pier for supporting a movable dwelling that substantially resists environmental forces, such as seismic and wind forces, and which includes means for anchoring the pier to a ground surface. The pier of the present invention includes a base with adjustment means extending upwardly therefrom for adjusting the height of the pier. In the preferred embodiment, the base comprises a plurality of elongated plates, but may comprise a single rectangular or circular plate. Coupling means are provided for securing the pier to a support beam of the dwelling. The coupling means are affixed to the adjustment means and comprise brackets configured to secure the pier to the support beam.

A plurality of force distribution members are coupled to the adjustment means for distributing force, including temporarily increased environmental forces applied to the dwelling. Preferably, a force distribution member is affixed to each of the base plates.

Clamp means are affixed to the force distribution members for retaining the adjustment means therein. The clamp means couple the force distribution members to the adjustment means, for preventing inadvertent movement therebetween. Particularly, the clamp means cause the force distribution members to cooperate with the adjustment means to transmit force from the adjustment means to the base, to increase the ability of the pier to withstand temporarily increased environmental forces applied to the dwelling.

In the preferred embodiment of the present invention, an anchor assembly for anchoring the pier to a ground surface is provided. The anchor assembly anchors the pier to the ground to prevent the pier from moving relative thereto, thus substantially increasing the pier's ability to withstand forces applied thereto. Preferably, the anchor assembly comprises a plurality of guides, with a guide affixed to each of the force distribution members, and a plurality of rods, with one rod provided for each guide. The rods are configured to slip-fit the guides for driving the rods into the ground. The guides are affixed to the force distribution members, so that rods extend obliquely into the ground for anchoring the pier to the ground. Preferably, the guides are affixed to the force distribution members so that rods extend into the ground in either a converging fashion or diverging fashion for positively anchoring the pier to the ground.

Preferably, each of the rods has a tapered first end for penetrating the ground and a flat second end for receiving blows from a driving implement, such as a hammer, for driving the rod into the ground. The second end of each of the rods may have a flange extending about the periphery thereof to prevent the second end from extending into the corresponding guide. The rods extend obliquely into the ground to prevent the rods from extending excessively into the ground, so that subterranean utility connections are not damaged by the rods when anchoring the pier to the ground, while positively anchoring the pier to the ground. The rods further inhibit the pier from uplifting from the ground, due to lateral forces applied to the pier, for example.

Additionally, a foundation pad may be provided for increasing the amount of vertical load that the invented pier can is capable of withstanding. The pad is interposed between the ground and base plates, and coupled to the base plates. The foundation pad is provided with a plurality of holes adjacent the force distribution members to allow the rods to extend through the pad and penetrate the ground.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

Figure 1:
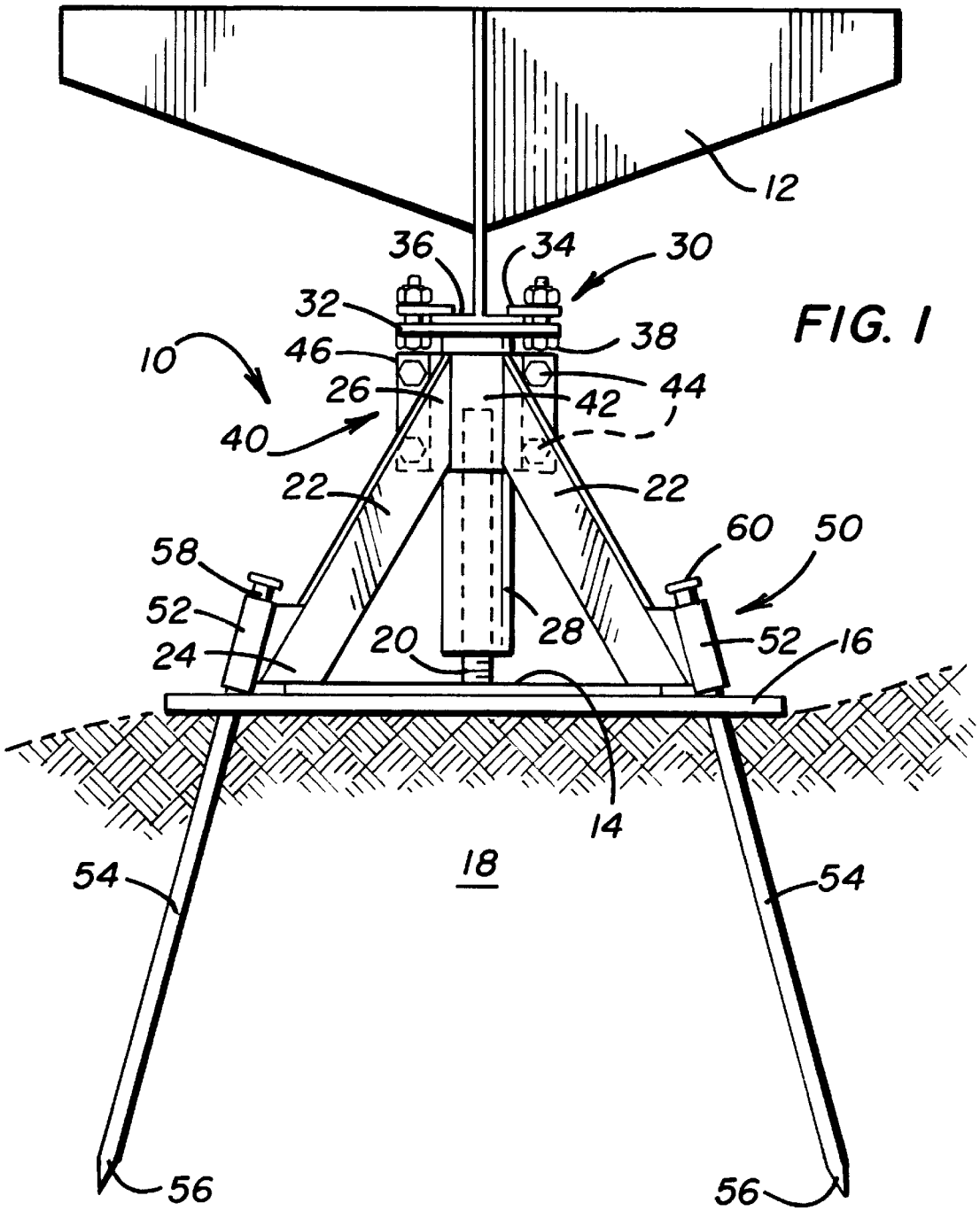
FIG. 1 is a front elevational view of a preferred embodiment of the pier of the present invention.

Referring now to FIG. 1 of the drawings, there is shown generally at 10, a first preferred embodiment of a foundation pier constructed according to the principles of the present invention. The pier 10 is shown secured to a support beam 12 of a movable dwelling, such as a commercial coach (not shown) for supporting the dwelling. The invented pier 10 is configured to resist substantial temporary increases in environmental forces, such as seismic and wind forces, and preferably comprises hardened steel alloy for example. A multiplicity of the piers 10 are attached to the support beams 12 for supporting the coach at predetermined spatial intervals. The distance between the piers 10 can depend upon several factors including, dimensions of the coach 12 to be supported, whether the piers 10 are being installed in an existing foundation system or in new foundation system, and the building codes and requirements enforced at an installation site.

Figure 2:
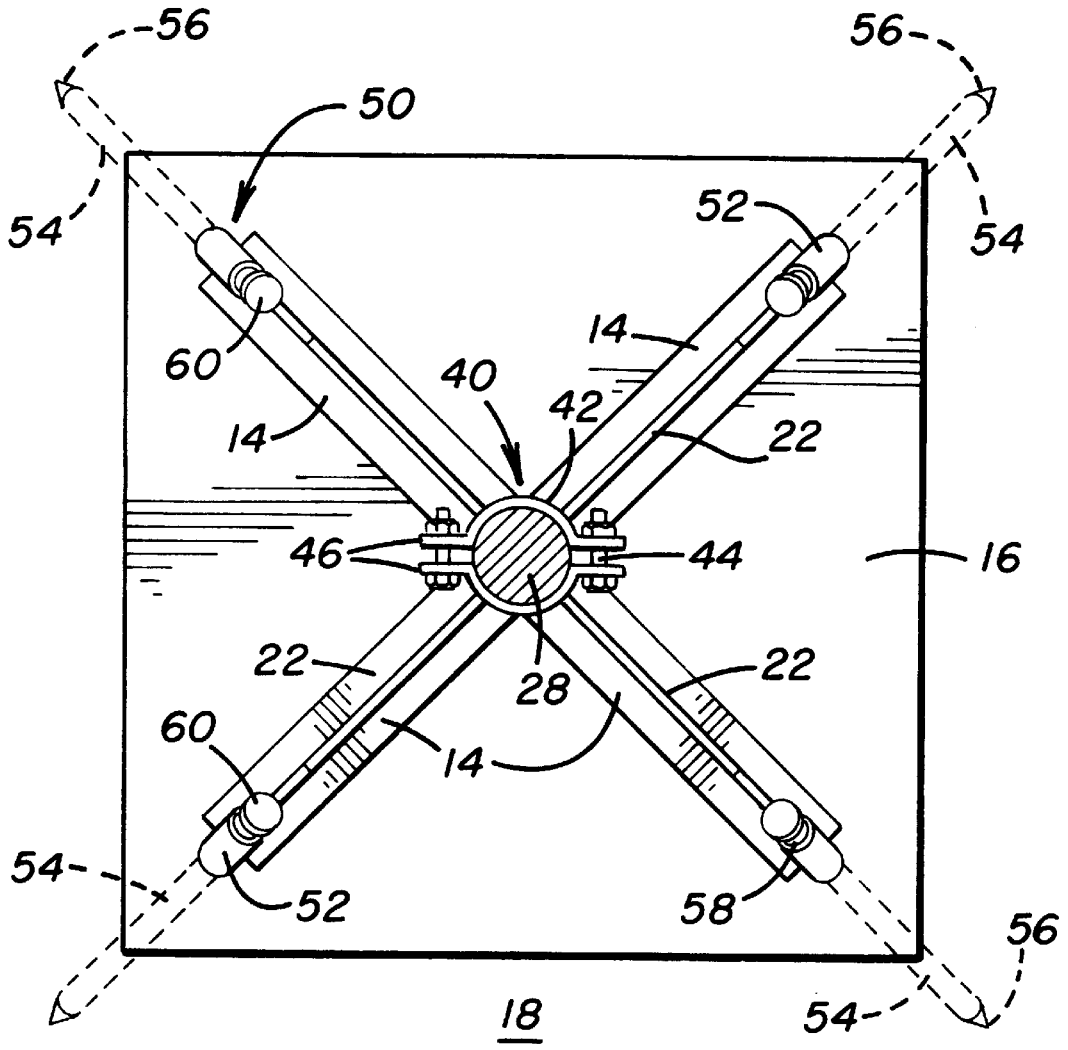
FIG. 2 is a top plan view of the preferred embodiment of the present invention.

Referring now to FIG. 1 and FIG. 2 of the drawings, in the first preferred embodiment, the invented pier 10 includes a plurality of flat, elongated base plates 14, configured in a cruciate configuration. However, the base 14 may comprise a single plate and be rectangular, circular, or other suitable configurations. A foundation pad 16 is preferably interposed between a ground surface 18 and base plates 14, and affixed to the plates 14. The foundation pad 16 is provided to aid with supporting the pier 10 and for increasing the amount of vertical load that the pier 10 can support. In the preferred embodiment, the pad 16 comprises a portion of plywood sheeting that is substantially ¾ thick, and has a length and a width greater than the diameter of the base plates 14. Preferably, the pad 16 is approximately 24 inches wide and 24 inches long.

A threaded shaft 20 is welded to the base 14 a centermost position thereof and extends perpendicular thereto. A plurality of force distribution members or webs 22 are equidistantly positioned about the shaft 20 and affixed to each of the base plates 14. Each distribution member 22 has a first end 24 affixed to a base plate 14 and a second end 26 that is adjacent the shaft 20. In the preferred embodiment, the pier 10 is configured with four distribution members 22, however the pier 10 can be configured with three or more members 22, depending upon the desired configuration of the force distribution members 22 or base 14, for example.

An elongated, support member 28 is threadably coupled to the shaft 20, as is disclosed in U.S. patent application Ser. No. 08/384,666, for adjusting the height of the pier 10. The support member 28 is dimensioned to reside between the second end 26 of the force distribution members 22. The support member 28 may vary in length, from approximately 4 to 14 inches, depending upon the desired height adjustment range of the pier 10.

Coupling means, shown generally at 30, are affixed to the support member 28 for securing the pier 10 to the support beam 12, to prevent relative movement between the pier 10 and beam 12. The coupling means 30 may comprise a flat head plate 32 affixed to an end of the support member 28 and a pair of coupling plates 34 disposed over a bottom portion 36 of the support beam 12, interposed between the coupling plates 34 and head plate 32. The coupling plates 34 are used to secure to the beam 12 to the head plate 32 using known means, such as nut-bolt combinations 38, as is known in the art.

Referring still to FIG. 1 and FIG. 2 of the drawings, clamp means, shown generally at 40, are affixed to the plurality of force distribution members 22. In the preferred embodiment, the clamp means 40 comprises complementary semi-arcuate portions 42 configured to receive the support member 28 therebetween. The portions 42 are affixed to the second end 26 of adjacent pairs of distribution members 22. A plurality of spatially positioned nut-bolts combinations 44 are disposed through holes (not shown) in sides 46 of the complementary portions 42, for causing the complementary portions 42 of the clamp means 40 to abut the support member 28, for coupling the distribution members 22 to the support member 28.

Figure 3:
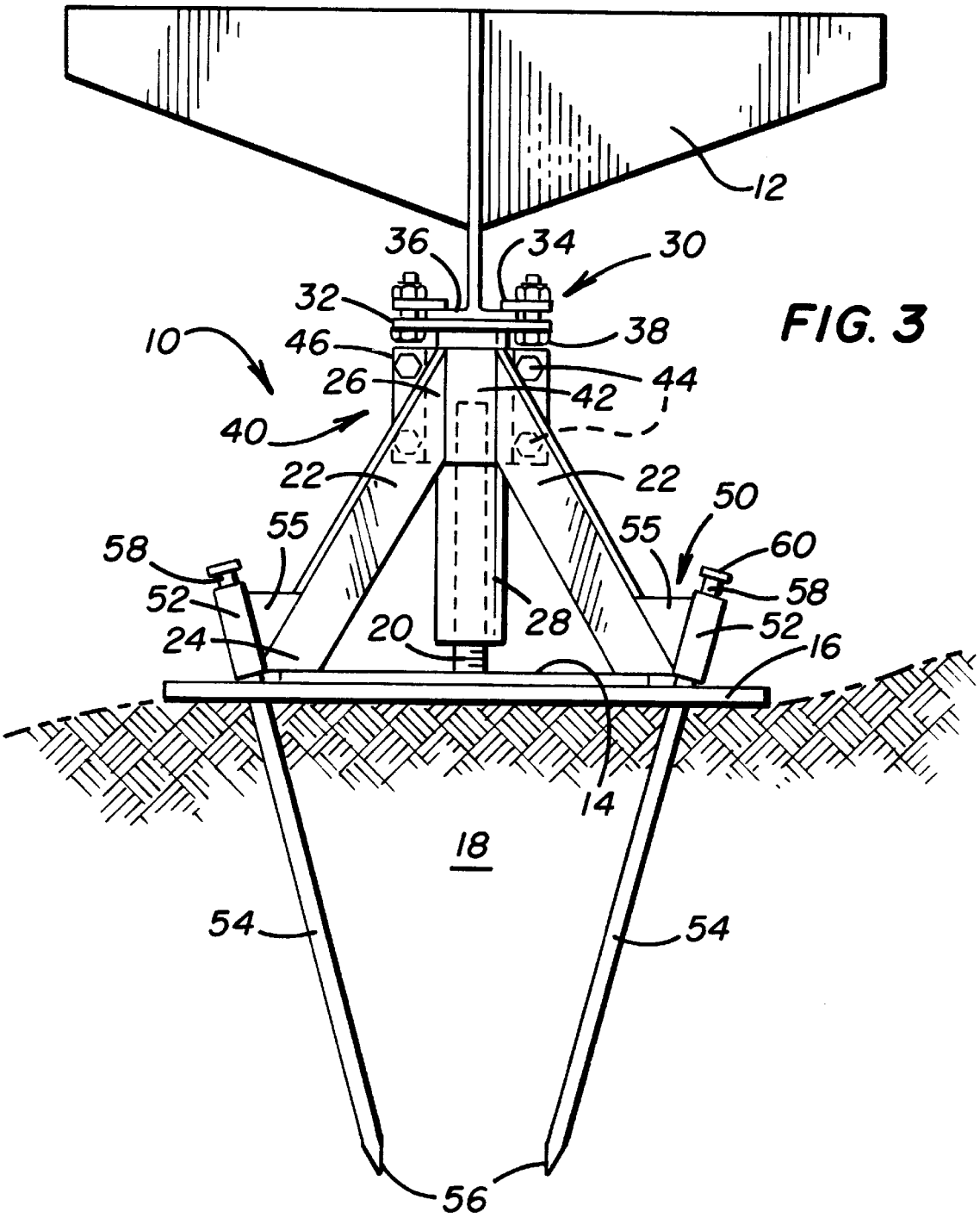
FIG. 3 is a front elevational view of an alternative embodiment of the pier of the present invention.

Referring now to FIG. 1 and FIG. 3 of the drawings, in the pier 10 of the present invention, an anchor assembly for anchoring the pier 10 to the ground 18, is shown generally at 50. The anchor assembly 50 preferably comprises a plurality of elongated tubular guides 52, with a guide 52 affixed to each of the force distribution members 22, and a plurality of rods 54, with one rod 54 provided for each guide 52. The guides 52 are affixed to the force distribution members 22 so that the rods 54 extend into the ground 18 in either a converging or diverging fashion. The guides 52 are preferably sufficiently long so that the rods 54 will bend, prior to the guides 52 bending, when driving the rods 54 into the ground 18.

As shown in FIG. 1, in the first preferred embodiment, the guides 52 are affixed to the force distribution members 22, so that rods 54 extend obliquely downwardly and divergently from the base 14 and into the ground 18. The foundation pad 16 is configured with a plurality of holes (not shown) positioned adjacent to the first end 24 of each of the force distribution members 22 for receiving each of the rods 54. The holes extend obliquely through the pad 16 so that the rods 54 can extend therethrough at an angle determined by the guides 52.

In the first embodiment, the guides 52 are affixed to the force distribution members 22 at an angle ranging from approximately 50° to approximately 85° to the base plates 14, and preferably ranging from approximately 65° to approximately 70° relative to the base 14. Thus, the guides 52 cause the rods 54 to extend obliquely into the ground 18, for preventing the rods 54 from extending excessively into the ground 18, so that subterranean utility connections (not shown) are not damaged by the rods 54, when anchoring the pier 10 to the ground 18, while positively anchoring the pier 10 thereto.

FIG. 3 shows the second preferred embodiment of the invented pier 10. In the second embodiment, the guides 52 are affixed to webs 55 secured to the force distribution members 22. The webs 55 position the guides 52 at an acute angle the base 14, so that rods 54 extend obliquely downwardly and convergently from the base 14 and into the ground 18, with tapered first ends 56 of the rods 54 being relatively close to one another. Preferably the acute angle ranges from approximately 30° to approximately 60°.

The rods 54 are preferably configured to slip-fit the guides 52 for driving the rods 54 into the ground 18 for anchoring the pier 10 thereto. Since the pier 10 is secured to the ground 18, the pier 10 is capable of withstanding up to approximately 3000 pounds of force, as opposed to similar prior art piers, which are typically capable of withstanding approximately 1000 pounds of force. The tapered first end 56 of each of the rods 54 aids with penetrating the ground 18, while a flat second end 58 thereof is provided for receiving blows from a driving implement (not shown) for driving the rod 54 into the ground 18. Additionally, the second end 58 of each of the rods 54 is configured with a flange 60 extending about the periphery thereof, to prevent the second end 58 from extending into the guide 52.

The rods 54 are preferably dimensioned to extend into the ground at a depth ranging from approximately 15 inches to approximately 20 inches, and preferably approximately 18 inches, while still providing room between the rod's second end 58 and support beam 12 when initially disposing the rod 54 in the guide 52. In the first preferred embodiment, the rods 54 are substantially 22 inches long. In the second embodiment, the rods 54 may be somewhat longer, due to the acute angle between the guides 52 and base 14. Further, in the first embodiment, the guides 52 cause the rods 54 to extend into the ground 18 at such an angle that the first end 56 of each of the rods 54 projects beyond a vertical plane extending around the periphery of the foundation pad 16. The angle that the rods 54 extend into the ground 18 at further inhibits the pier 10 from uplifting from the ground 18, due to lateral forces, for example.

Thus, there has been described an improved foundation pier for supporting a movable dwelling, that is provided with an anchor assembly for positively anchoring the pier to the ground. The invented pier includes an anchor assembly comprising a plurality of guides, a guide affixed to each force distribution member, and a plurality of rods, each rod configured to slide through a guide and extend into the ground. The guides are affixed to the force distribution members, so that rods extend obliquely into the ground for anchoring the pier to the ground. Preferably, the guides are affixed to the force distribution members so that rods extend into the ground in either a converging fashion or diverging fashion for positively anchoring the pier to the ground.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A foundation pier adapted to be secured to a support beam of a movable dwelling for supporting the dwelling and for resisting seismic forces applied to the dwelling, the pier comprising:

support means for supporting the pier on a ground surface;

means for adjusting the height of the pier, the adjusting means including means for retaining the pier at different predetermined heights and for resisting seismic forces applied to the dwelling;

securing means for securing the pier to the support beam, the securing means affixed to the adjusting means and attached to the support beam for preventing relative movement between the support bean and pier;

anchor means for securing the pier to the ground, the anchor means having a plurality of guides; and a plurality of rod members with one rod member adapted to extend through each guide and into the ground surface a depth of approximately 15 to 20 inches the guides positioned at an oblique angle relative to the support means, so that the rod members extend obliquely into the ground for anchoring the pier thereto.

2. The pier of claim 1 wherein the guides are positioned such that the rod members extend obliquely into the ground in a diverging fashion.

3. The pier of claim 2 wherein the guides are positioned at an angle ranging from approximately 50° to approximately 85° relative to the support means so that the rod members extend obliquely into the ground for anchoring the pier thereto.

4. The pier of claim 2 wherein the guides are positioned at an angle ranging from approximately 60° to approximately 75° relative to the support means so that the rod members extend obliquely into the ground for anchoring the pier thereto.

5. The pier of claim 1 wherein the guides are positioned such that the rod members extend obliquely into the ground in a converging fashion.

6. The pier of claim 5 wherein the guides are positioned at an angle ranging from approximately 30° to approximately 60° relative to the support means so that the rod members extend obliquely into the ground for anchoring the pier thereto.

7. The pier of claim 1 wherein the adjusting means further comprises clamp means to aid with retaining the pier at different predetermined heights and for enhancing the ability of the pier to resist seismic forces of up to 3,000 pounds.

8. The pier of claim 1 further comprising a foundation pad interposed between the ground and support means for supporting the pier, the foundation pad increasing the amount of vertical load that the pier is capable of withstanding, the pad provided with a plurality of holes extending obliquely therethrough to allow the rod members to extend through the pad and penetrate the ground.

9. A foundation pier for supporting a movable dwelling and for resisting seismic forces applied to the dwelling and to the pier, the pier comprising:

a base;

adjustment means affixed to the base and extending upwardly therefrom for adjusting the height of the pier;

coupling means for securing the pier to a support beam of the dwelling, the coupling means affixed to the adjustment means and comprising bracket members configured to secure the pier to the support beam;

a plurality of force distribution members disposed equidistantly about the base and affixed thereto, the force distribution members coupled to the adjustment means for distributing force, including seismic forces of up to 3,000 pounds applied to the dwelling and to the pier;

clamp means affixed to the force distribution members for retaining the adjustment means therein, the clamp means coupling the force distribution members to the adjustment means for preventing inadvertent movement therebetween, the clamp means causing the force distribution members to cooperate with the adjustment means to increase the ability of the pier to withstand seismic forces applied to the dwelling; and an anchor assembly for anchoring the pier to a ground surface, the anchor assembly comprising a plurality of guides with one guide affixed to each of the force distribution members, and a plurality of rods with one rod provided for each guide, the rods configured to slide through the guides and be driven into the ground, the guides affixed to the force distribution members, such that rods extend downwardly and obliquely into the ground a depth of approximately 15 to 20 inches for anchoring the pier thereto.

10. The pier of claim 9 wherein the anchor assembly further comprises:

each of the rods having a tapered first end to penetrate the ground and a flat second end with a flange extending about the periphery thereof to aid with driving the rod into the ground and to prevent the second end of the rod from extending into the corresponding guide, the rods extending downwardly and obliquely from the base into the ground.

11. The pier of claim 10 wherein the guides are affixed to the force distribution members such that the rods extend obliquely into the ground in a diverging fashion.

12. The pier of claim 11 wherein the guides are affixed to the force distribution members at an angle ranging from approximately 60° to approximately 75° relative to the base so that the rods extend obliquely into the ground for anchoring the pier thereto.

13. The pier of claim 10 wherein the guides are affixed to the force distribution members such that the rods extend obliquely into the ground in a converging fashion.

14. The pier of claim 13 wherein the guides are affixed to the force distribution members at an angle ranging from approximately 35° to approximately 55° relative to the base so that the rods extend obliquely into the ground for anchoring the pier thereto.

15. The pier of claim 9 further comprising a foundation pad interposed between the ground and base to aid with supporting the pier and for increasing the amount of vertical load that the pier can support, the pad provided with a plurality of holes disposed obliquely therethrough to allow the rods to extend through the pad and downwardly and outwardly into the ground, the foundation pad having a length and a width greater than a diameter of the base.

16. A foundation pier for supporting a movable dwelling and for resisting seismic forces applied to the dwelling and to the pier, the pier comprising:

a base;

adjustment means affixed to the base and extending upwardly therefrom for adjusting the height of the pier;

coupling means for securing the pier to a support beam of the dwelling, the coupling means affixed to the adjustment means and comprising bracket members configured to secure the pier to the support beam;

a plurality of force distribution members affixed to the base, the force distribution members coupled to the adjustment means for distributing force, including seismic forces of up to 3,000 pounds applied to the dwelling and to the pier;

clamp means affixed to the force distribution members for retaining the adjustment means therein, the clamp means coupling the force distribution members to the adjustment means for preventing inadvertent movement therebetween, the clamp means causing the force distribution members to cooperate with the adjustment means to increase the ability of the pier to withstand seismic forces applied to the dwelling; and an anchor assembly for anchoring the pier to a ground surface, the anchor assembly comprising a plurality of elongated tubular guides with a guide affixed to each of the force distribution members, and a plurality of rods with one rod provided for each guide, the rods configured to slip-fit the guides for driving the rods into the ground, the guides affixed to the force distribution members, such that rods extend downwardly and obliquely from the base and into the ground for penetrating the ground to positively anchor the pier thereto, each of the rods having a tapered first end for penetrating the ground and a flat second end for receiving blows from a driving implement for driving the rod into the ground, the second end of each of the rods having a flange extending about the periphery thereof to prevent the second end from extending into the corresponding guide as the rods are driven into the ground, the rods extending obliquely into the ground a depth of approximately 15 to 20 inches.

17. The pier of claim 16 further comprising a foundation pad interposed between the ground and base and affixed to the base plates, the foundation pad provided to aid with supporting the pier and for increasing the amount of vertical load that the pier can support, the pad provided with a plurality of holes disposed obliquely therethrough to allow the rods to extend through the pad and downwardly into the ground, the foundation pad having a length and a width greater than a length and a width of the base.

18. The pier of claim 16 wherein the guides are affixed to the force distribution members such that the rods extend obliquely downwardly from the base and into the ground in a diverging fashion, through the foundation pad, such that the first end of each of the rods projects beyond a vertical plane extending around the periphery of the foundation pad.

19. The pier of claim 16 wherein the guides are affixed to the force distribution members such that the rods extend obliquely into the ground in a converging fashion.

* * * * *